United States Patent [19]

Liang

[11] 4,353,461

[45] Oct. 12, 1982

[54] MERCHANDISE PACKAGING SYSTEM

[76] Inventor: Wang-Tao Liang, A2, 3rd Fl. Mount Trio Ct., Waterloo Road Hill, Kowloon, Hong Kong

[21] Appl. No.: 194,822

[22] Filed: Oct. 7, 1980

[51] Int. Cl.[3] ..... B65D 5/54; B65D 65/06; B65D 65/12

[52] U.S. Cl. ..... 206/45.34; 206/216; 206/461; 229/87 R

[58] Field of Search ..... 206/45.34, 45.31, 45.23, 206/45.14, 461, 462, 216; 229/87 R

[56] References Cited

U.S. PATENT DOCUMENTS

| | | | |
|---|---|---|---|
| 2,676,699 | 4/1954 | Friedman | 206/45.31 |
| 3,011,629 | 12/1961 | Rohdin | 206/45.31 |
| 3,442,371 | 5/1969 | Deshong et al. | 206/45.23 |
| 3,498,446 | 3/1970 | Lafreniere | 206/45.34 |
| 3,829,008 | 8/1974 | Murry et al. | 206/216 |

*Primary Examiner*—William T. Dixson, Jr.
*Attorney, Agent, or Firm*—Edmond T. Patnaude

[57] ABSTRACT

A card carries a transparent blister for holding and displaying an article of merchandise, and the card may be reverse folded after purchase into a box which encloses the blister and the article and has an attractive outer surface printed with a gift wrap so as to eliminate the need for additional gift wrapping paper.

9 Claims, 6 Drawing Figures

MERCHANDISE PACKAGING SYSTEM

The present invention relates in general to the art of packaging merchandise for point of purchase display, and it relates in particular to a new and improved package and method of packaging wherein a card carrying merchandise thereon may be folded, after purchase, into a box containing the associated merchandise.

BACKGROUND OF THE INVENTION

In the retail trade it is important to display the merchandise in such a fashion that it can be readily examined by the customer and yet provide a measure of protection to the article itself and discourage pilferring. Blister packs and skin packs wherein the articles of merchandise are encapsulated between a clear plastic sheet and a relatively large card are ideal for this purpose, and these types of packages are thus widely used for the point of purchase display of small items of merchandise.

When a blister-packed item is purchased and these types of packages are thus widely used for the point of purchase display of small items of merchandise.

When a blister-packed item is purchased as a gift, it must ordinarily be placed in a box of proper dimensions and then enclosed in wrapping paper suitable for the occasion. In some cases only the wrapping paper is used, but the resulting package is usually unattractive. In either case, however, it is necessary to purchase or otherwise obtain the additional wrapping material.

SUMMARY OF THE INVENTION

Briefly, in accordance with the present invention there is provided a novel display package which includes a card to which the merchandise to be displayed is mounted and which is constructed so as to be foldable into a gift box containing the merchandise. Preferably one surface of the card is printed with a design appropriate for a typical gift-giving occasion, such for example, as a birthday, and that printed surface provides the exterior of the box. Moreover, the merchandise need not be removed from the card wherefor it remains protected while the gift box, and any pertinent information printed on the display card cannot be inadvertently separated from the merchandise.

GENERAL DESCRIPTION OF THE DRAWING

The present invention will be better understood by a reading of the following detailed description taken in connection with the accompanying drawing wherein.

DETAILED DESCRIPTION OF THE INVENTION

Figure 1:
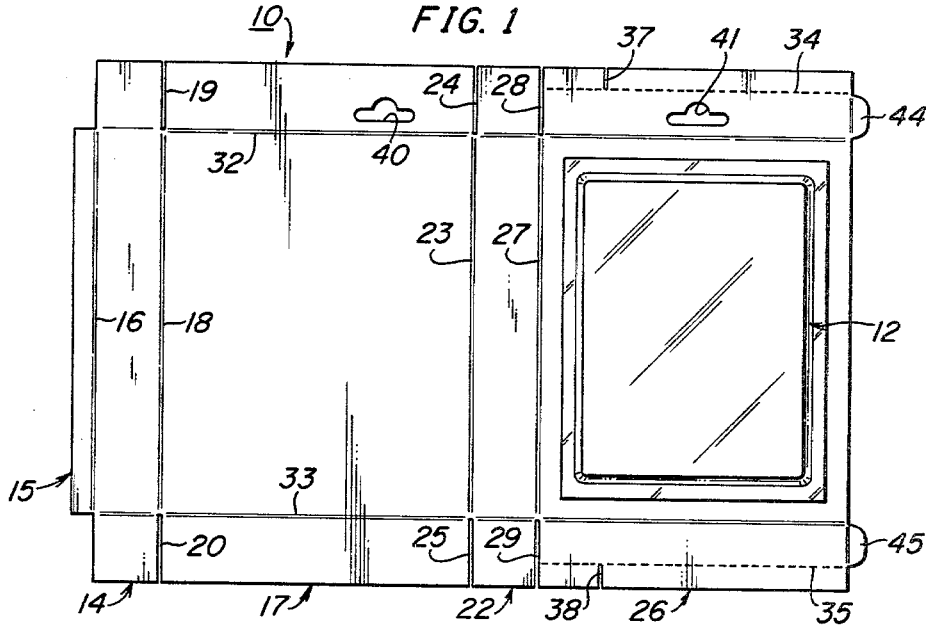
FIG. 1 is a plan view of a display card and package embodying the present invention in an open position.
Figure 6:
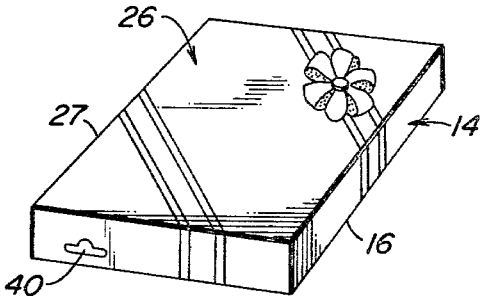
FIG. 6 is a perspective view of the completed gift box.

Referring to FIG. 1 of the drawing, a display card and gift box includes a paperboard blank 10 having a transparent plastic blister 12 peripherally sealed thereto in any suitable manner such as by heat sealing. The card is provided with a plurality of slits and fold lines which enables it to be folded into the display condition shown in FIG. 2 for display merchandise (not shown) mounted to the front face of the card by the blister 12 or into a box containing the blister and merchandise as shown in FIG. 6. Although the blister is shown in FIG. 1 in a mounted condition, ordinarily the blank 10 will be folded into the display condition shown in FIGS. 2 and 3 before the merchandise and the blister 12 are sealed to the blank.

Figure 5:
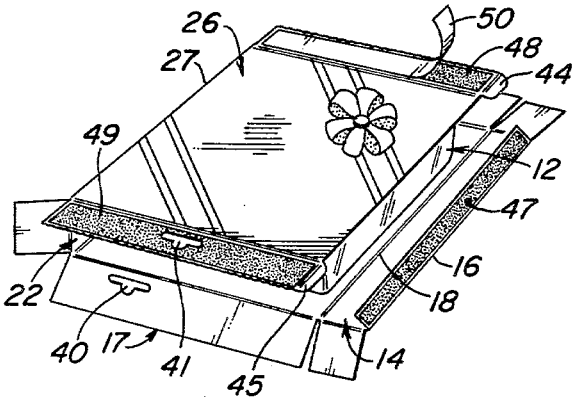
FIG. 5 is a perspective view showing the article of the invention as the gift box is being completed.

The blank card 10 is generally rectangular and has a first, narrow, rectangular section 14 which forms one side of the gift box. An elongated, rectangular tab 15 is provided along the outer edge of the section 14 and is separated therefrom by a fold line or crease 16. Adjacent the section 14 is a large rectangular section 17 separated from the section 14 by a fold line 18 and colinear slits 19 and 20. The section 17 provides the back wall of the box (bottom as shown in FIGS. 5 and 6). Next adjacent the section 17 is a second, narrow, rectangular section 22 separated from the section 17 by a fold line 23 and colinear slits 24 and 25. Next adjacent the section 32 is another large rectangular section 26 equal in overall dimensions to the section 17 and separated from the section 22 by a fold line 27 and colinear slits 28 and 29. The section 26 provides the surface against which the merchandise is encapsulated by the blister 12 and it also functions as the front wall of the box (top and shown in FIGS. 5 and 6).

As best shown in FIG. 1, the card 10 is provided with a pair of mutually parallel fold lines 32 and 33 extending in directions transverse to the fold lines 18, 23 and 27. The fold lines 32 and 33 separate each of the sections 14, 17, 22 and 26 into a large central part and top and bottom parts which are folded over one another to form the two ends of the completed box as shown in FIG. 6. Also, the section 26 is provided with a pair of perforated or tear lines 35 and 35 near the respective top and bottom edges thereof and a pair of slits 37 and 38 which are parallel to the slits 28 and 29 and spaced therefrom by a distance equal to the width of the section 22.

The front face of the card 10 as shown in FIG. 1 is printed with information pertaining to the merchandising of the product being displayed including such things as assembly and operating instructions where appropriate. The rear side of the card (not visible in FIG. 1) is printed with a suitable design such as that of common gift wrapping paper. When the card is folded into the box condition as shown in FIG. 6 the rear face of the card constitutes the entire outer surface of the box.

Figure 2:
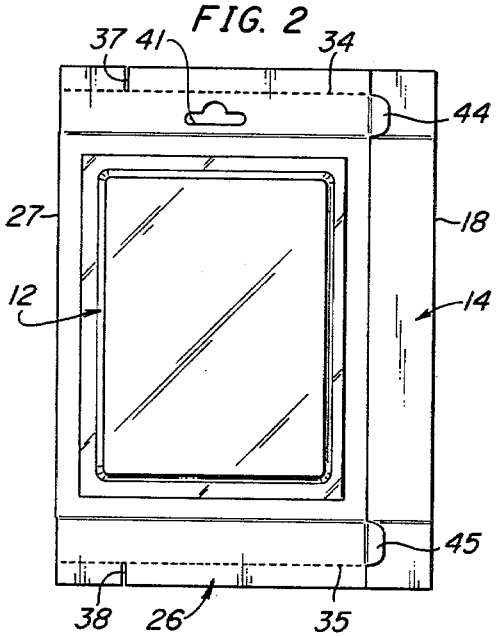
FIG. 2 is a view of the article of FIG. 1 in a display condition.
Figure 3:
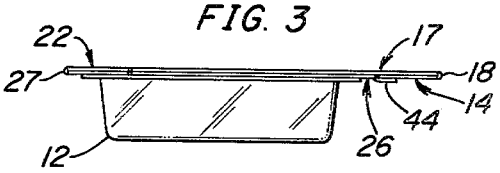
FIG. 3 is a view taken from the top of FIG. 2.

With particular reference to FIGS. 2 and 3, it may be seen that when the card 10 is in a display condition the section 22 and a portion of the section 17 underlies the section 26. Moreover, the section 14 is folded over the remaining portion of the section 17 and the tab 15 underlies the right hand edge portion of the section 26. The card 10 is secured in the display condition by means of adhesive strips applied to the rear face of the card 10 in the areas above the tear line 34 and below the tear line 35. These two stripes of adhesive permanently bond the adjoining areas of the card together. It may be seen that the blank card 10 is provided with punched-out openings 40 and 41 which are mutually aligned in the display condition shown in FIG. 2. These openings enable the card to be hung on a hook or the like for display of the merchandise encapsulated by the blister 12. If desired, the exposed face of the section 14 may be printed with a portion of the pattern which is printed on the rear of the card and will provide the outer surface of the box when the card has been folded into the gift-box configuration.

Figure 4:
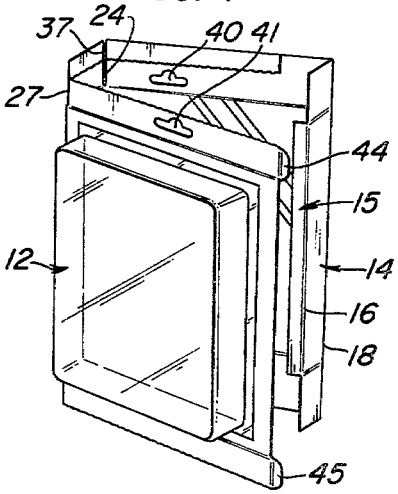
FIG. 4 is a perspective view of the article of the invention in the process of being changed from a display card to a gift box.

After the customer has purchased the article, the card may be opened by tearing it along the tear lines 34 and 35. A pair of finger tabs 44 and 45 are provided to facilitate this operation. The card is then folded back on itself through the condition shown in FIG. 4 to that shown in FIG. 5.

The rear side of the tab 15 and the areas between the tear line 34 and 35 and the fold line 32 and 33 on the rear side of the section 26 are provided with a pressure sensitive adhesive stripes 47, 48 and 49 covered by removable paper strips, only one such strip, strip 50, being shown in FIG. 5. When the card has been folded into the condition shown in FIG. 5. The strips are removed and the adhesive stripes are used to seal the box in the closed condition as shown in FIG. 6. It may be seen that the openings 40 and 41 do not overlap, wherefor the contents of the box are completely enclosed. Also when forming the box, the finger tabs 44 and 45 are folded under the section 14 and the tab 15 is pressed against the inside surface of the distal edge portion of the section 26.

While the present invention has been described in connection with a particular embodiment thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. A display package for displaying merchandise and for subsequently boxing said merchandise, comprising a card foldable back on itself to provide a generally planar multilayer display card and the other face of said card is folded directly on itself wherein one face of said card provides the front and back exposed surfaces of said display card, means secured to said one face on the front of said display card for holding merchandise against said one face, and said card being provided with a plurality of fold lines and slits to permit said card to be folded along said lines to form a polygonal box wherein said one face of said card constitutes the interior surface of said box and said other face of said card constitutes the exterior surface of said box and said merchandise held against said one face is enclosed by said box.

2. A display package according to claim 1 wherein the other face of said card has a design printed thereon.

3. A display package according to claim 2 wherein said merchandise is mounted to said card by means of a sheet of transparent plastic.

4. A display package according to claim 1 comprising pressure sensitive adhesive means provided on said card for securing said card in the shape of said polygonal box.

5. A display package according to claim 4 wherein said box is a hexahedron.

6. A display package according to claim 1 comprising a transparent plastic sheet secured to said one face of said card over said merchandise.

7. A display package according to claim 1 comprising means for removably securing said card in the condition in which it is folded back on itself to provide a display card.

8. A merchandising package for displaying merchandise for sale and for gift wrapping said merchandise comprising a flat card having a front face and a rear face and a plurality of fold lines thereon defining front and rear panel sections and a plurality of side sections, a transparent blister secured to the front face of said card over said front panel section for holding merchandise therein, said card being foldable along one of said lines to provide a display card in which the front face of said rear panel section is disposed against the rear face of said front panel section, means for detachably securing said front and rear panel sections together with said rear faces of said panel sections being face to face, and said card being foldable along said fold lines into the shape of a six sided box with said blister being disposed within said box and said rear face of said card constituting the external surface of said box.

9. A merchandise package according to claim 7 wherein said rear face of said card is printed with a gift wrap design.

* * * * *